US008170230B1

(12) United States Patent
Ramirez

(10) Patent No.: US 8,170,230 B1
(45) Date of Patent: May 1, 2012

(54) REDUCING AUDIO MASKING

(75) Inventor: Daniel Ramirez, Seattle, WA (US)

(73) Assignee: Adobe Systems Incorporated, San Jose, CA (US)

( * ) Notice: Subject to any disclaimer, the term of this patent is extended or adjusted under 35 U.S.C. 154(b) by 919 days.

(21) Appl. No.: 12/192,465

(22) Filed: Aug. 15, 2008

(51) Int. Cl.
*H04R 3/02* (2006.01)

(52) U.S. Cl. ..... 381/73.1; 381/119; 381/106; 381/107; 381/108

(58) Field of Classification Search ..... 381/73.1, 381/119, 106–108
See application file for complete search history.

(56) References Cited

U.S. PATENT DOCUMENTS

2005/0281418 A1* 12/2005 Shashoua ..... 381/119

OTHER PUBLICATIONS

Holger Classen, U.S. Appl. No. 11/840,402, filed Aug. 17, 2007.
Holger Classen, U.S. Appl. No. 11/840,416, filed Aug. 17, 2007.
Daniel Ramirez, U.S. Appl. No. 11/756,586, filed May 31, 2007.

* cited by examiner

*Primary Examiner* — Zandra Smith
*Assistant Examiner* — Paul Patton
(74) *Attorney, Agent, or Firm* — Fish & Richardson P.C.

(57) ABSTRACT

This specification describes technologies relating to reducing audio masking. In general, one aspect of the subject matter described in this specification can be embodied in methods that include the actions of receiving a primary audio signal and a secondary audio signal; for each audio signal, calculating an average perceived intensity over time for each of a plurality of frequency bands; comparing the average perceived intensity of the secondary audio signal with the average perceived intensity of the primary audio signal for each frequency band; and for each frequency band where the average perceived intensity of the secondary audio signal is greater than the average perceived intensity of the primary audio signal by a specified threshold amount, attenuating the secondary audio signal by a specified amount to form a modified secondary audio signal.

39 Claims, 11 Drawing Sheets

700

702

704 706

| | Name | Volume | Perceived Volume | Peak |
|---|---|---|---|---|
| (0Hz-300Hz) | Primary Signal (0Hz-300Hz).wav | -26.11 dB | -26.92 dB | -17.51 dB |
| | Secondary Signal (0Hz-300Hz).... | -19.10 dB | -18.86 dB | -06.81 dB |
| | Name | Volume | Perceived Volume | Peak |
| (300Hz-640Hz) | Primary Signal (300Hz-640Hz).w... | -25.26 dB | -24.68 dB | -14.82 dB |
| | Secondary Signal (300Hz-640Hz... | -19.62 dB | -17.02 dB | -11.11 dB |
| | Name | Volume | Perceived Volume | Peak |
| (640Hz-1080Hz) | Primary Signal (640Hz-1080Hz).... | -23.85 dB | -22.53 dB | -16.01 dB |
| | Secondary Signal (640Hz-1080H... | -13.54 dB | -11.62 dB | -07.86 dB |
| | Name | Volume | Perceived Volume | Peak |
| (1080Hz-2000Hz) | Primary Signal (1080Hz-2000Hz... | -28.23 dB | -23.17 dB | -18.17 dB |
| | Secondary Signal (1080Hz-2000... | -09.64 dB | -06.81 dB | -04.57 dB |
| | Name | Volume | Perceived Volume | Peak |
| (2000-3150Hz) | Primary Signal (2000Hz-3150Hz... | -36.08 dB | -28.29 dB | -23.39 dB |
| | Secondary Signal (2000Hz-3150... | -25.25 dB | -16.36 dB | -15.78 dB |
| | Name | Volume | Perceived Volume | Peak |
| (3150-5300Hz) | Primary Signal (3150Hz-5300Hz... | -37.86 dB | -28.44 dB | -24.38 dB |
| | Secondary Signal (3150Hz-5300... | -27.46 dB | -19.34 dB | -18.83 dB |
| | Name | Volume | Perceived Volume | Peak |
| (5300Hz-9500Hz) | Primary Signal (5300Hz-9500Hz... | -32.63 dB | -30.47 dB | -20.73 dB |
| | Secondary Signal (5300Hz-9500... | -47.37 dB | -45.39 dB | -31.83 dB |
| | Name | Volume | Perceived Volume | Peak |
| (9500Hz-22050Hz) | Primary Signal (9500Hz-22050H... | -41.66 dB | -40.00 dB | -31.32 dB |
| | Secondary Signal (9500Hz-2205... | -58.96 dB | -58.71 dB | -27.47 dB |

708

Summary: 2 Files Now have a Perceived Loudness of -26.92 dB, Matching Primary Signal (0Hz-300Hz).wav.

| Name | Change |
|---|---|
| Primary Signal (0Hz-300H... | +0.00 dB |
| Secondary Signal (0Hz-3... | -8.06 dB |

Summary: 2 Files Now have a Perceived Loudness of -24.68 dB, Matching Primary Signal (300Hz-640Hz).wav.

| Name | Change |
|---|---|
| Primary Signal (300Hz-640Hz).wav | +0.00 dB |
| Secondary Signal (300Hz-640Hz).wav | -7.66 dB |

Summary: 2 Files Now have a Perceived Loudness of -22.53 dB, Matching Primary Signal (640Hz-1080Hz).wav.

| Name | Change |
|---|---|
| Primary Signal (640Hz-1080Hz).wav | +0.00 dB |
| Secondary Signal (640Hz-1080Hz).wav | -10.91 dB |

Summary: 2 Files Now have a Perceived Loudness of -23.17 dB, Matching Primary Signal (1080Hz-2000Hz).wav

| Name | Change |
|---|---|
| Primary Signal (1080Hz-2000Hz).wav | +0.00 dB |
| Secondary Signal (1080Hz-2000Hz).w... | -16.35 dB |

Summary: 2 Files Now have a Perceived Loudness of -28.29 dB, Matching Primary Signal (2000Hz-3150Hz).wav

| Name | Change |
|---|---|
| Primary Signal (2000Hz-3150Hz).wav | +0.00 dB |
| Secondary Signal (2000Hz-3150Hz).w... | -11.93 dB |

Summary: 2 Files Now have a Perceived Loudness of -28.44 dB, Matching Primary Signal (3150Hz-5300Hz).wav

| Name | Change |
|---|---|
| Primary Signal (3150Hz-5300Hz).wav | +0.00 dB |
| Secondary Signal (3150Hz-5300Hz).w... | -9.10 dB |

FIG. 7

REDUCING AUDIO MASKING

BACKGROUND

The present disclosure relates to editing audio signals.

Audio signals including audio data can be provided by a multitude of audio sources. Examples include audio signals from an FM radio receiver, a compact disc drive playing an audio CD, a microphone, or audio circuitry of a personal computer (e.g., during playback of an audio file).

When audio signals are provided using microphones, one or more of the microphones are usually associated with particular audio signals, e.g., a musician playing an instrument in an orchestra or a person singing in a band. Additionally, the number of microphones used to capture particular audio signals can be high. In such a setting, it is not uncommon to collect audio signals using microphones from thirty or more sources. For example, a drum set alone may require five or more microphones. Individual groups of instruments can have one or more microphones in common (e.g., in an orchestral setting). Additionally, single instruments are often exclusively associated with one or more microphones.

Audio sources, regardless of the way the audio signals are provided (i.e., whether providing signals using microphones or not), provide signals including audio data identifying different audio properties. Examples of audio properties include signal intensity, signal kind (e.g., stereo, mono), stereo width, and phase (or phase correlation, e.g., of a stereo signal).

The process of modifying the properties of multiple audio signals in relation to each other, in relation to other audio signals, or combining audio signals is referred to as mixing. A device for such a purpose is referred to as a mixer or an audio mixer. A particular state of the mixer denoting the relationship of multiple audio signals is typically referred to as a mix.

Masking is a psychoacoustic phenomenon where perception of one audio signal is reduced or prevented because of the presence of another audio signal. Masking can depend both on the intensity of the audio signals relative to each other and the frequencies of the audio signals relative to each other. Thus, an audio signal at a particular frequency and intensity can be masked by another audio signal at the same frequency but higher intensity. For example, a particular narration signal can be mixed with a background music signal. However, when the two signals are mixed, the background music can mask regions of the narration.

One technique for reducing masking is side-chain compression, also referred to as "ducking". In side-chain compression, a primary audio signal is provided as a side-chain input to a compressor. If the intensity of the primary audio signal exceeds a specified threshold intensity the compressor attenuates another secondary signal, typically by an amount proportional to the amount the threshold was exceeded for the duration the signal exceeds the threshold. Side-chain compression is, therefore, generally based only on the overall intensity of the primary signal across all frequencies and without consideration of the audio properties of the secondary signal.

SUMMARY

This specification describes technologies relating to reducing audio masking.

In general, one aspect of the subject matter described in this specification can be embodied in methods that include the actions of receiving a primary audio signal and a secondary audio signal; for each audio signal, calculating an average perceived intensity over time for each of multiple frequency bands; comparing the average perceived intensity of the secondary audio signal with the average perceived intensity of the primary audio signal for each frequency band; and for each frequency band where the average perceived intensity of the secondary audio signal is greater than the average perceived intensity of the primary audio signal by a specified threshold amount, attenuating the secondary audio signal by a specified amount to form a modified secondary audio signal. Other embodiments of this aspect include corresponding systems, apparatus, and computer program products.

These and other embodiments can optionally include one or more of the following features. The secondary audio signal is attenuated for a particular frequency band by an amount such that the average perceived intensity of the secondary audio signal corresponds to the average perceived intensity of the primary audio signal for that frequency band. The average perceived intensity is calculated over an entire duration of the primary and the secondary audio signals, and where the attenuation of a particular frequency band attenuates the secondary audio signal at that frequency band over the entire audio signal. The average perceived intensity is calculated over an entire duration of a shorter audio signal of the primary and the secondary audio signals, and where the attenuation of a particular frequency band attenuates the secondary audio signal at that frequency band over a duration equal to the shorter audio signal.

The method further includes receiving a first audio signal and a second audio signal and calculating a priority between the first audio signal and the second audio signal such that the higher priority audio signal becomes the primary audio signal and the lower priority audio signal becomes the secondary audio signal. The method further includes receiving multiple audio signals; calculating a relative priority for each audio signal of the multiple audio signals; arranging pairs of audio signals in a hierarchy according to priority, where each pair includes a primary audio signal and a secondary audio signal according to the calculated priority; and combining pairs of audio signals up the hierarchy to generate two audio signals. The method further includes mixing the primary audio signal and the modified secondary audio signal to provide a mixed output signal. The method further includes storing the mixed output signal.

An amount of attenuation applied to the secondary signal is capped by a specified amount. The threshold amount is a minimum difference between the average perceived intensity of the primary audio signal and the average perceived intensity of the secondary audio signal. The method further includes identifying one or more regions of an audio signal of the primary and secondary audio signals as silence and dividing the audio signal into two or more discrete audio signals, where the two or more discrete audio signals do not include the one or more regions identified as silence.

In general, one aspect of the subject matter described in this specification can be embodied in methods that include the actions of receiving a primary audio signal and a secondary audio signal; for each audio signal, separating the audio data into multiple time slices and frequency bands to form multiple bins, each bin including audio data for a particular frequency band and time duration; calculating an average perceived intensity of each bin; comparing the average perceived intensity of each bin in secondary audio signal with the average perceived intensity of a corresponding bin in the primary audio signal; and for each bin where the average perceived intensity of the secondary audio signal is greater than the average perceived intensity of the corresponding bin of the primary audio signal, attenuating the secondary audio signal corresponding to the bin by a specified amount to form a modified secondary audio signal bin, according to one or more criteria; and combining the modified secondary audio signal bins with unmodified secondary audio signal bins to form a modified secondary audio signal. Other embodiments of this aspect include corresponding systems, apparatus, and computer program products.

These and other embodiments can optionally include one or more of the following features. The one or more criteria includes a primary audio signal threshold floor, where the primary threshold floor identifies a minimum average perceived intensity of audio data in a bin of the primary audio signal in order to apply an attenuation to corresponding bin of the secondary audio signal.

Particular embodiments of the subject matter described in this specification can be implemented to realize one or more of the following advantages. Users with little or no expertise in adjusting audio frequencies can quickly reduce masking between audio signals. The masking reduction can be used to automatically generate a rough mix of audio signals that can be fine tuned using other techniques, reducing user work. Additionally, masking reductions can be performed in live settings as inputs are received from audio sources (e.g., a concert performance) where input audio signals are prioritized (e.g., with vocals as primary signal).

The details of one or more embodiments of the invention are set forth in the accompanying drawings and the description below. Other features, aspects, and advantages of the invention will become apparent from the description, the drawings, and the claims.

BRIEF DESCRIPTION OF THE DRAWINGS

FIG. 7 illustrates an example of perceived loudness of the primary and secondary audio signals for particular frequency bands before and after modifying particular portions of the secondary audio signal.

Like reference numbers and designations in the various drawings indicate like elements.

DETAILED DESCRIPTION

Figure 1:
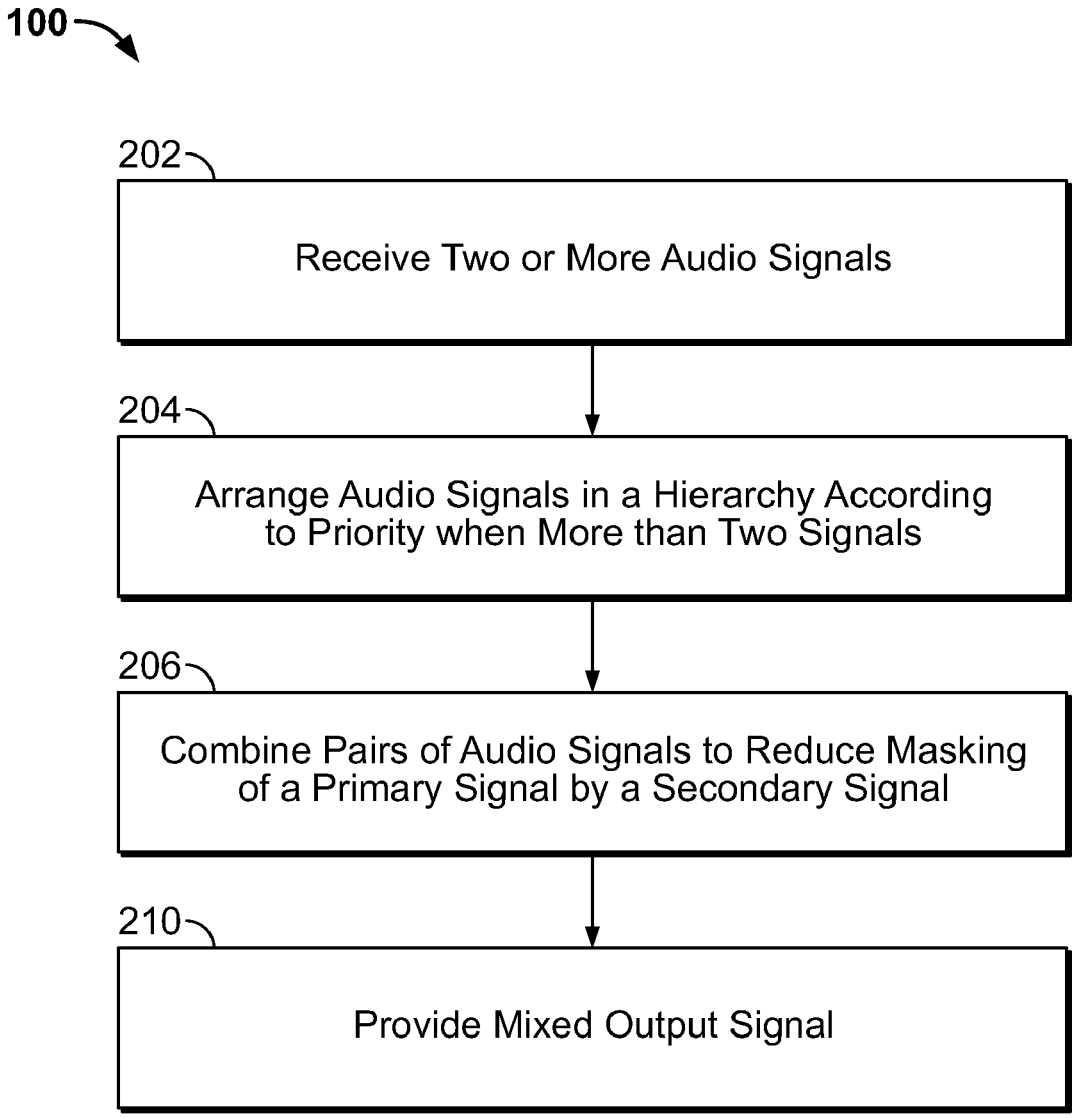
FIG. 1 is a flow chart of an example method for reducing masking.

FIG. 1 is a flow chart of an example method 100 for reducing masking. For convenience, the method 100 will be described with respect to a system that will perform the method 100.

The system receives 102 multiple audio signals. Each audio signal has associated audio data. The audio data describes different properties of the audio signal. For example, the audio data can identify properties of the audio signal with respect to time including intensity, frequency, phase, and balance.

The multiple audio signals can be received, for example, as one or more audio files or embedded within other types of files (e.g., embedded with a video file). Alternatively, the audio signals can be received from one or more input channels into a digital audio workstation. Visual representations of the audio signals can be displayed in an interface of the digital audio workstation, for example, as multi-track audio including multiple distinct tracks. A track represents a distinct section of an audio signal, usually having a finite length and including at least one distinct channel. For example, a track can be digital stereo audio data contained in an audio file, the audio data having a specific length (e.g., running time). The different tracks, and thus the different signals, can be combined into a mixdown track using a mixer. The mixdown track includes a combination of the audio signals, for example, to be output from the digital audio workstation as a single audio signal.

The system identifies 104 a primary audio signal and a secondary audio signal from the received audio signals. When more than two audio signals are received, two or more audio signals are combined to generate a secondary audio signal to use with the primary audio signal. The primary audio signal is a highest priority audio signal. For example, if a first audio signal is a narration and a second audio signal is background music, the narration can be identified as the highest priority audio signal and the background music as the secondary audio signal.

In some implementations, the audio signals have been previously ordered according to priority or can be presented to the user for manual ranking (e.g., by ordering the corresponding audio tracks). For example, a visual representation of the audio signal of each track can be presented to a user within an interface of the digital audio workstation. The user can then order the tracks.

In some other implementations, the system uses information associated with the audio signals to automatically assign priority to the audio signals. Particular priority values can be designated for types of audio signals. The system can use track metadata, for example, to identify a type of audio signal contained within the track. For example, tracks including audio signals corresponding to vocals can be assigned a higher priority than tracks including audio signals corresponding to instrumentation. Additionally, different types of instrumentation can have different priority levels (e.g., piano can be assigned a higher priority than percussion).

The audio signals are ordered by assigned priority. For example, if the system received four audio signals (e.g., as four separate audio files), the signals are ordered from 1-4. In some implementations, if there are more than two signals, the system pre-mixes all signals other than the primary signal to form a single secondary signal. However, in some other implementations, the system arranges the received audio signals in a hierarchy according to priority and then pre-mixes the audio signals in steps moving through the hierarchy in a bottom-up process.

Figure 2:
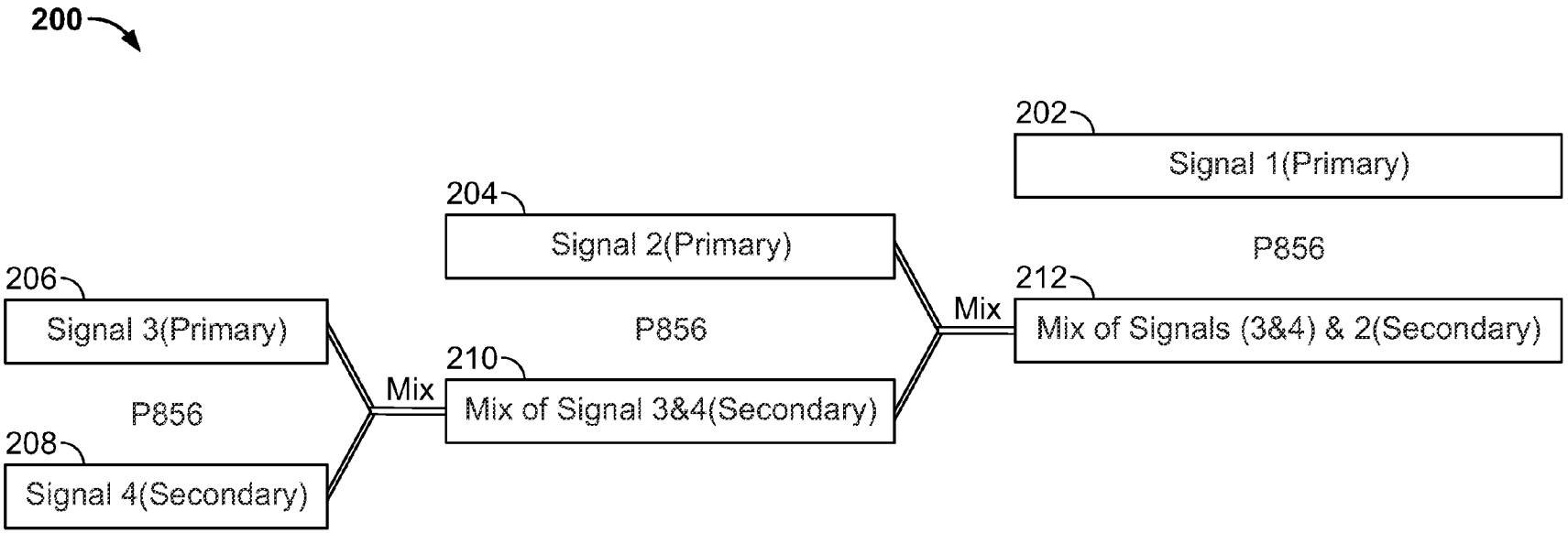
FIG. 2 shows an example premixing diagram for multiple audio signals having specified priorities.

FIG. 2 shows an example premixing diagram 200 for multiple audio signals having specified priorities. The premixing diagram 200 shows each of four received audio signals, signal one 202, signal two 204, signal three 206, and signal four 208. The signals are arranged in hierarchical structure according to priority. In particular, signal one 202 is the primary signal while each other signal is a secondary signal to the primary signal and positioned in the hierarchy according to relative priority. Signal four 208 is the lowest priority signal and is combined with signal three 206. Signal three 206 is considered a primary audio signal relative to signal four 208.

A mix of signals three and four 210 is then combined with signal two 204, which is a primary audio signal relative to the mix of signals three and four 210. A mix of signals two three and four 212 is then combined with signal one 202, which is the primary signal to the combined signals. This bottom-up mixing of relative primary and secondary audio signals can be performed in a similar manner at each step to reduce masking between the mixed signals.

As shown in FIG. 1, the system combines 206 pairs of audio signals, a primary and a secondary audio signal, to reduce masking of the primary signal as caused by the secondary signal. The system provides 210 the mixed audio signal as an output. For example, the output signal can be played, stored as a single audio file (e.g., a stored mixdown track as a single audio file), transmitted as a single audio signal, or processed by another component of the digital audio workstation.

Figure 3:
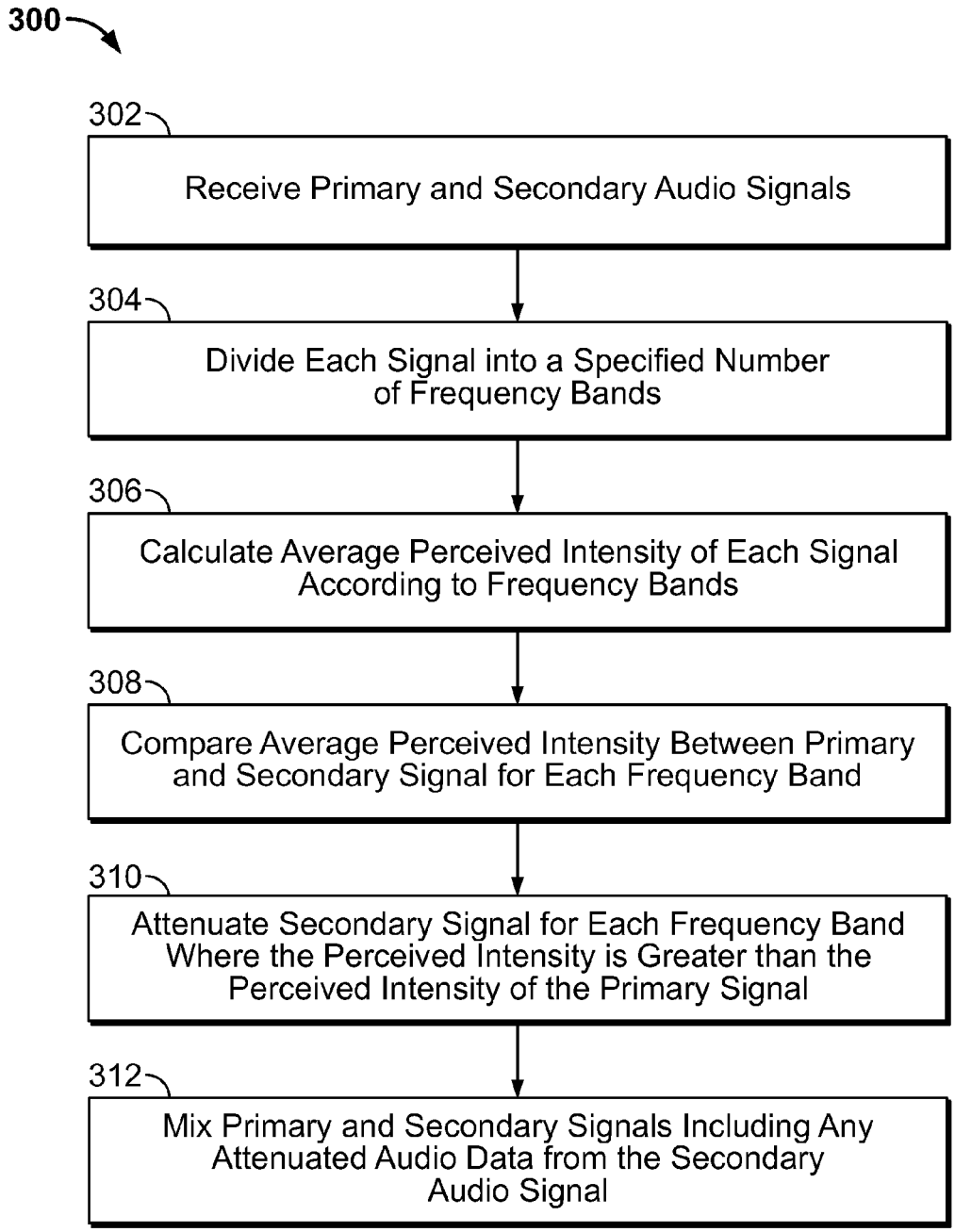
FIG. 3 is flow chart of an example method for combining audio signals to reduce masking.

FIG. 3 is flow chart of an example method 300 for combining audio signals to reduce masking. For convenience, the method 300 will be described with respect to a system that will perform the method 300.

The system receives 302 a primary audio signal and a secondary audio signal. The audio signals can be individual audio signals or audio signals that have been combined from a previous pre-mixing process as described above with respect to FIGS. 1 and 2.

The system 304 divides each signal into a specified number of corresponding frequency bands. Each frequency band covers a portion of the frequency spectra, for example, from 0 Hz to 20,000 Hz. In some implementations, each frequency band has a range covering an equal number of frequencies. For example, each frequency band can cover a frequency range of 1000 Hz.

In other implementations, the frequency range of particular frequency bands can vary according to one or more criteria. For example, the primary audio signal often will include voice content that should have priority over other signals. The system can more finely process frequencies within the vocal range (e.g., from 1 kHz to 3 kHz). For example, frequency bands covering these particular frequencies (e.g., those which human voices occur) can have a smaller range of frequencies in each band than other frequency bands such that those frequencies are more finely tuned than frequency bands unlikely to have human voices.

The system calculates 306 an average perceived intensity of each signal according to one or more of the frequency bands. Perceived intensity, or loudness, can vary from the actual intensity (i.e., signal amplitude). Specifically, for an audio signal at a constant intensity, the perceived intensity of the audio signal will vary depending on the frequency of the signal. For example, humans are more attuned to human voices, and as a result audio data at frequencies corresponding to human voices are perceived as louder than audio data at other frequencies having the same actual intensity. Conversely, humans are less attuned to very low frequency signals (e.g., 20 Hz-200 Hz). Various techniques can be used to calculate perceived intensity. The relationship between frequency and perceived intensity can be calculated, for example, using equal loudness curves or mathematical formulas relating intensity, frequency, and perceived intensity. The relationship can be based, for example, on empirical data where individuals identify tones of different frequencies as having the same loudness. This relationship can then be used by the system to determine the perceived intensity for any given signal intensity/frequency combination (e.g., by applying an equal loudness curve to a received audio signal). Thus, for example, frequencies that would be perceived as louder are boosted, while frequencies perceived as less loud are attenuated to calculate values of perceived intensity.

For each frequency band, the system calculates an average perceived intensity over the entire audio signal. In particular, the entire audio signal is considered a single time slice equal to the duration of the shorter audio signal where the system calculates the average perceived intensity across the entire time duration for each frequency band.

For example, the system can use Fourier transforms (e.g., a fast Fourier transform (FFT)) to separate the frequencies of the audio signal into each frequency band in order to identify the perceived intensity of the audio data in the audio signal corresponding to those frequencies. In some implementations, the perceived intensity within a particular frequency band is sampled over a specified number of points for the duration of the audio signal (e.g., at a specified sampling rate), the values of which can be averaged to calculate the average perceived intensity for that frequency band.

For example, for a frequency band from 100 Hz to 200 Hz, an FFT can be calculated that separates the audio data of the audio signal within that frequency band. The perceived intensity values can then be calculated for discrete points in the audio signal (e.g., every second for the entire length of the audio signal). The average perceived intensity can then be calculated by summing the perceived intensity for each point and dividing by the number of discrete points. The points can be particular samples according to a specified sampling rate over the entire duration of the audio signal.

In an alternative example, the system can use one or more filters to separate the audio data of each signal into particular frequency bands. For example, a band pass filter can be tuned to each frequency band in order to isolate the audio data of the audio signal by frequency. The average perceived intensity for each frequency band can then be calculated as described above. For example, the calculated perceived intensity for samples within the frequency band are averaged together.

The system compares 308 the calculated average perceived intensity for each frequency band between the primary audio signal and the secondary audio signal. The average perceived intensities are compared to determine whether the perceived intensity of the secondary audio signal is greater than the perceived intensity of the primary audio signal for audio data of each frequency band.

The system attenuates 310 the audio data of the secondary audio signal for each frequency band where the perceived intensity of the secondary audio signal is greater than the perceived intensity of the primary audio signal. When the perceived intensity of the secondary audio signal is not greater than the perceived intensity of the primary audio signal for a particular frequency band, the system maintains the perceived intensity of the primary audio signal and the secondary audio signal. Thus, audio data within the frequency band of the audio signals is not modified.

However, when the perceived intensity of the secondary audio signal is greater than the perceived intensity of the primary audio signal for a particular frequency band, the system attenuates the audio data of the secondary audio signal corresponding to the frequency band. For example, the audio data of the particular frequency band in the secondary audio signal can be attenuated such that the average perceived intensity of the secondary audio signal matches the average perceived intensity of the primary audio signal for that frequency band.

In some implementations, the system determines whether the average perceived intensity of the secondary audio signal is greater than the average perceived intensity of the primary audio signal by a threshold amount. If the difference between the average perceived intensities does not exceed the threshold amount, the system does not attenuate the secondary audio for that frequency band. However, if the difference between the average perceived intensities does exceed the threshold amount, the system does attenuate the secondary audio for that frequency band.

The attenuation is performed across the entire duration of the secondary audio signal. For example, for a given frequency band, if the average perceived intensity of the secondary audio signal is −10 dB and the average perceived intensity of the primary audio signal is −15 dB, the attenuation is performed to reduce the average perceived intensity of the secondary audio signal to −15 dB (e.g., based on a scale having a maximum intensity of 0 dB, thus the more negative the intensity, the softer the audio).

Alternatively, the attenuation amount can be a specified difference between a post processed secondary signal and the primary signal, e.g., −5 dB. In some other implementations, the magnitude of the attenuation could be capped at a maximum (e.g., 6 dB) regardless of the difference between the average perceived intensities. Additionally, in some implementations, the secondary audio signal is attenuated such that the average perceived intensity is less than the average perceived intensity of the primary audio signal.

In another example, the attenuation of the secondary audio signal can be determined as a function of the average perceived intensity of the secondary audio signal (e.g., proportional to a magnitude of the average perceived intensity or based on a difference between the average perceived intensities).

The system mixes 312 the primary audio signal and the secondary audio signal including any attenuated audio data from the secondary audio signal. For example, the mixer of the digital audio workstation can sum the primary audio signal and the secondary audio signal to generate a single mixed audio signal. The mixed audio signal can be output from the mixer for playback, further processing (e.g., as part of a signal processing chain), editing in the digital audio workstation, saving as a single file locally or remotely, or transmitting or streaming to another location.

Additionally, the mixed audio signal can be mixed with other audio signals, for example, another audio signal that is primary to the mixed audio signal. The new primary audio signal can be mixed with the new secondary mixed audio signal in a similar manner as described above.

Figure 4:
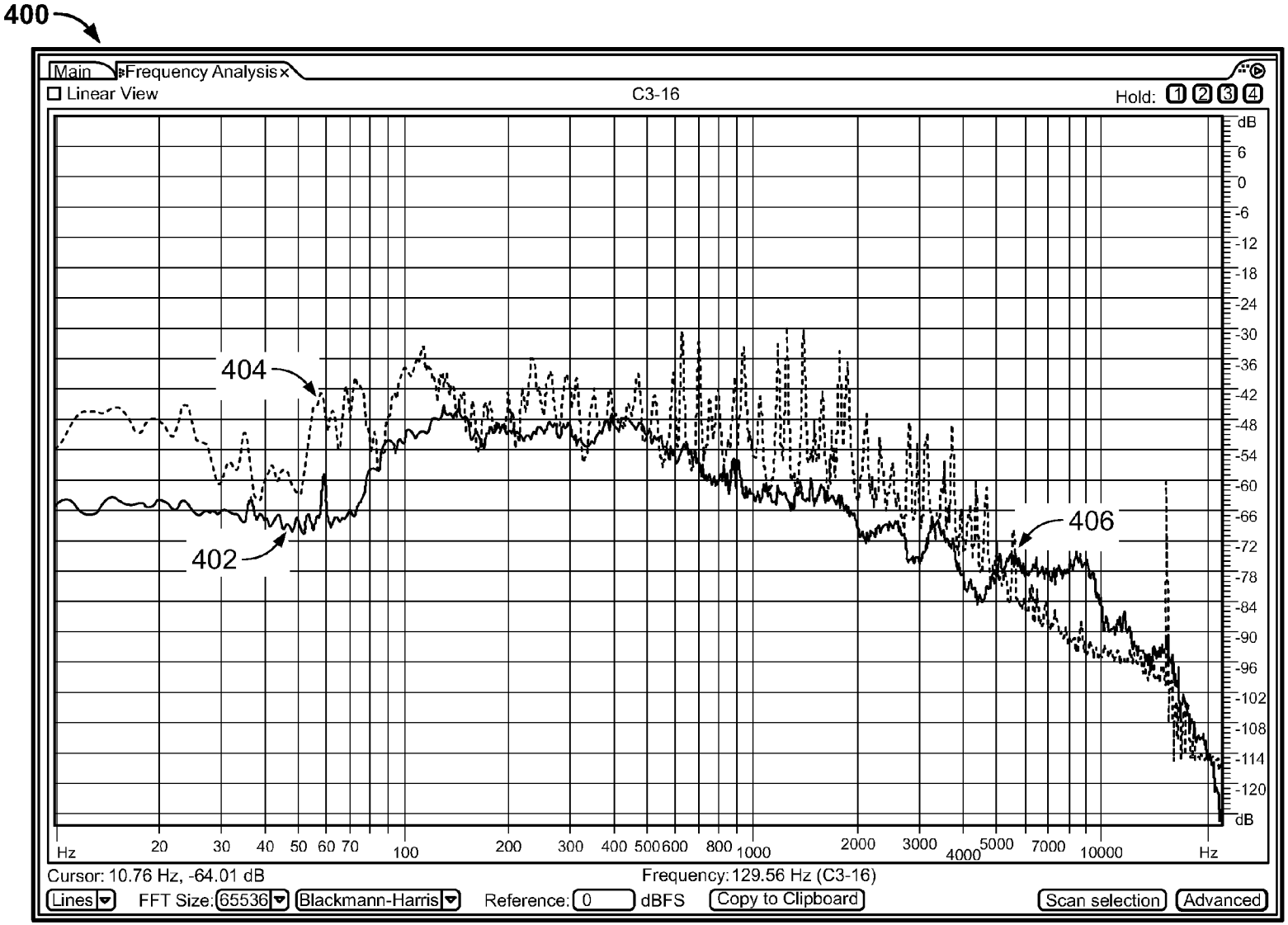
FIG. 4 is an example frequency response diagram showing a primary audio signal and a secondary audio signal.
Figure 5:
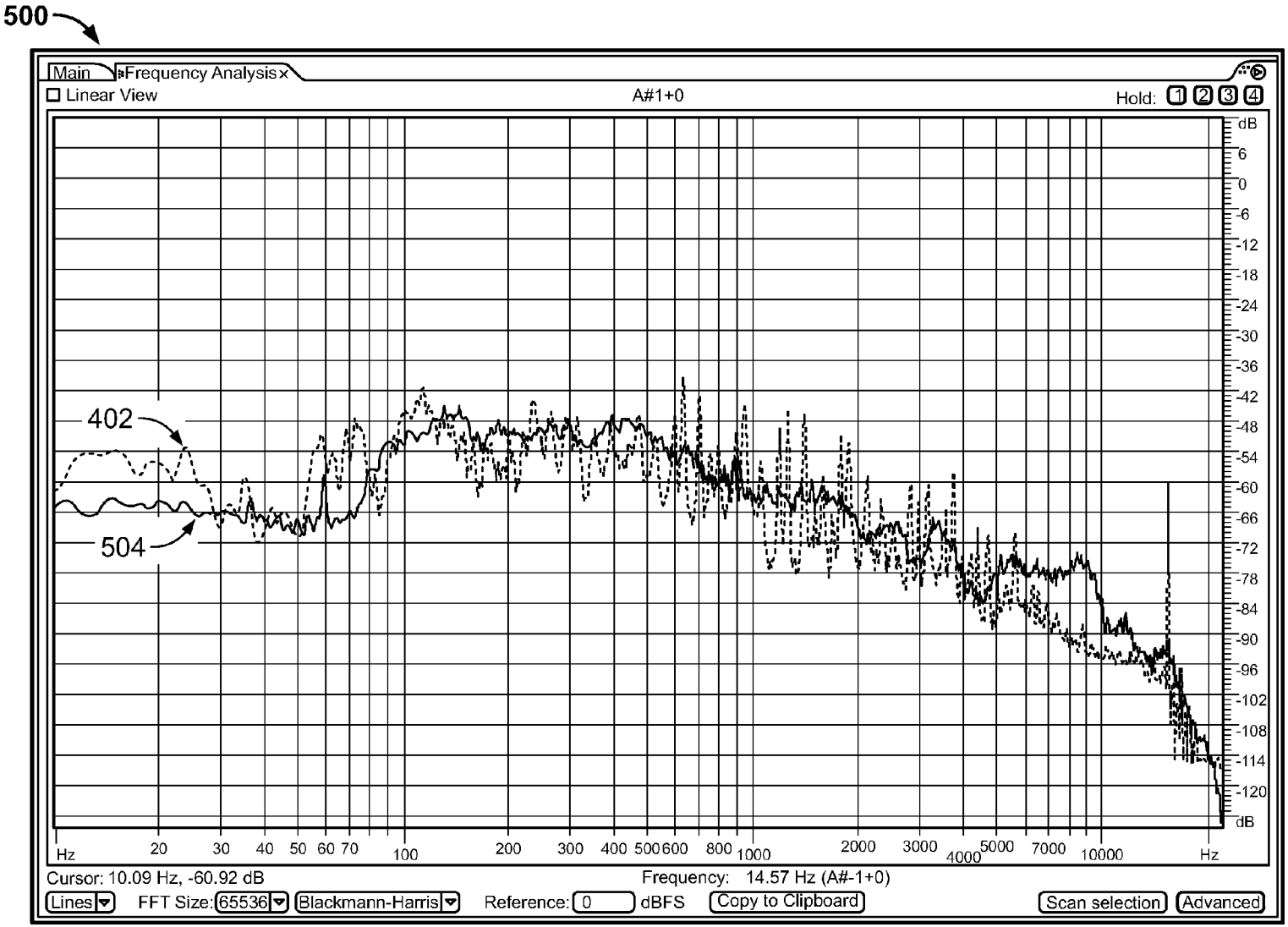
FIG. 5 is an example frequency response diagram showing a primary audio signal and a modified secondary audio signal.
Figure 6:
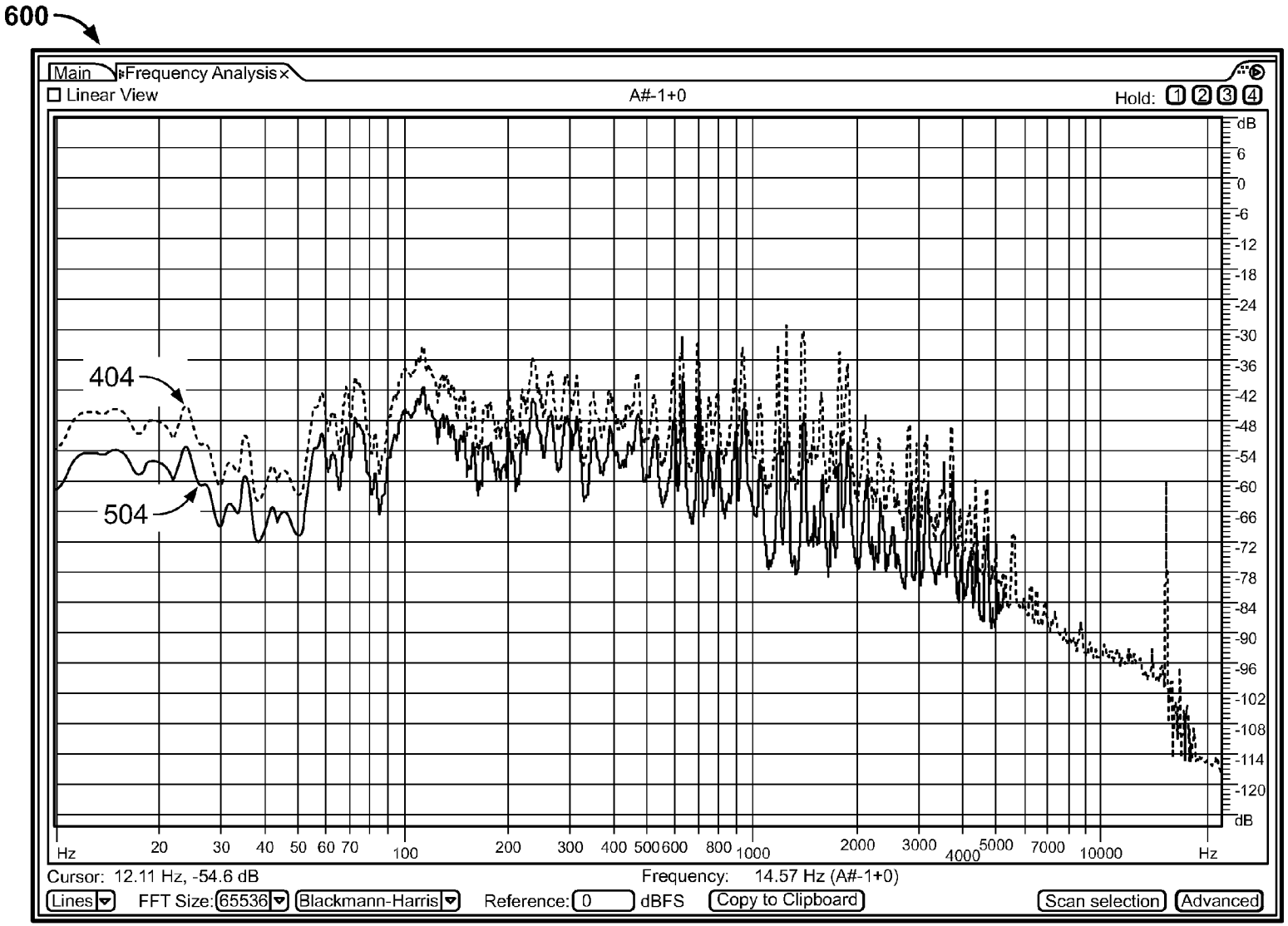
FIG. 6 is an example frequency response diagram showing the secondary audio signal and the modified secondary audio signal, of FIGS. 4 and 5, respectively.

FIGS. 4-6 show example frequency response diagrams for audio signals with respect to frequency and intensity. Although, the diagrams indicate actual average intensity versus average perceived loudness, the relationship between the audio signals shown in FIGS. 4-6 are analogous to the method 300 described above.

FIG. 4 is an example frequency response diagram 400 showing a primary audio signal 402 and a secondary audio signal 404. The frequency response diagram 400 displays an average intensity of the primary audio signal 402 and the secondary audio signal 404 with respect to frequency. In some implementations, the average intensity of each signal is determined over the entire duration of the respective audio signals. Frequency in hertz (Hz) is displayed, on a logarithmic scale, on the x-axis while average intensity in decibels (dB) is displayed on the y-axis.

The frequency response diagram 400 shows that the average intensity of the secondary signal 404 is greater than the average intensity of the primary audio signal 402 over most frequencies shown in the display. In particular, the secondary audio signal 404 does not generally dip below the average intensity level of the primary audio signal 404 until after 5000 Hz 406. Consequently, the secondary audio signal 404 can mask the primary audio signal 402 at frequencies below 5000 Hz.

FIG. 5 is an example frequency response diagram 500 showing the primary audio signal 402 and a modified secondary audio signal 504. As with frequency response diagram 400 shown in FIG. 4, the frequency response diagram 500 displays an average intensity of the primary audio signal 402 and the modified secondary audio signal 504 over time with respect to frequency. The modified secondary audio signal 504 corresponds to the secondary audio signal 404 of FIG. 4 that has been attenuated for particular frequency bands.

Specifically, the modified secondary audio signal 504 represents an attenuated secondary audio signal 404 at frequencies below substantially 5000 Hz. For frequencies above substantially 5000 Hz, the modified secondary audio signal 504 has the same average intensity as the secondary audio signal 404. Thus, the modified secondary audio signal 504 includes audio data attenuated at some frequencies but not others based on the compared average intensities of the primary and secondary audio signals. As shown in the frequency response diagram 500, the attenuation reduces difference between the average intensity of the primary audio signal 402 and the modified secondary audio signal 504 relative to the difference between the average intensity of the primary audio signal 402 and the secondary audio signal 404 shown in FIG. 4.

FIG. 6 an example frequency response diagram 600 showing the secondary audio signal 404 and the modified secondary audio signal 504 of FIGS. 4 and 5, respectively. As shown in the frequency response diagram 600, for frequency bands below substantially 5000 Hz, the modified secondary audio signal 504 generally has a lower average intensity than the secondary audio signal 404. However, for frequency bands above substantially 5000 Hz, depending a range of the respective frequency bands about 5000 Hz, the secondary audio signal and modified secondary audio signal merge. This is because the modified secondary audio signal 504 is not attenuated for higher frequency bands where the average intensity of the primary audio signal (e.g., primary audio signal 402) is greater than the average intensity of the secondary audio signal 404.

FIG. 7 illustrates an example diagram 700 of average perceived intensity of the primary and secondary audio signals for particular frequency bands before and after attenuating particular portions of a secondary audio signal. In particular, the diagram 700 shows parameters for primary and secondary audio signals for each of a number of frequency bands 702. For each frequency band 702, the diagram 700 displays an average intensity 704 of the respective audio signals and an average perceived intensity 706 of the respective audio signals.

For example, for the frequency band from 0 Hz to 300 Hz, the average perceived intensity 706 of the primary signal is −26.92 dB while the average perceived intensity 706 of the secondary audio signal is −18.86 dB. Thus, the secondary audio signal has a higher average perceived intensity than the primary audio signal from 0 Hz to 300 Hz.

By contrast, for the frequency band from 9500 Hz to 22,050 Hz, the average perceived intensity 706 of the primary signal is −40.00 dB while the average perceived intensity 706 of the secondary audio signal is −58.71 dB. Thus, the primary audio signal has a higher average perceived intensity than the secondary audio signal in that frequency band from 9500 Hz to 22,050 Hz.

The diagram 700 also displays parameters for the primary and secondary audio signals after processing to reduce masking for each frequency band. For example, block 708 shows parameters for the frequency band from 0 Hz to 300 Hz after attenuation. The secondary signal has been attenuated such that both the primary audio signal and the secondary audio signal have an average perceived intensity within the frequency band of −26.92 dB. Moreover, the secondary signal has been modified by attenuation in the amount of −8.06 dB. Matching the average perceived intensity for each frequency band can reduce masking effects produced by the secondary audio signal.

Additionally, the diagram 700 does not indicate any additional parameters for frequency bands from 5300 Hz to 9500 Hz and from 9500 Hz to 22,050 Hz since the average perceived intensity for the primary signal was greater than the average perceived intensity for the secondary signal for these frequency bands.

Figure 8:
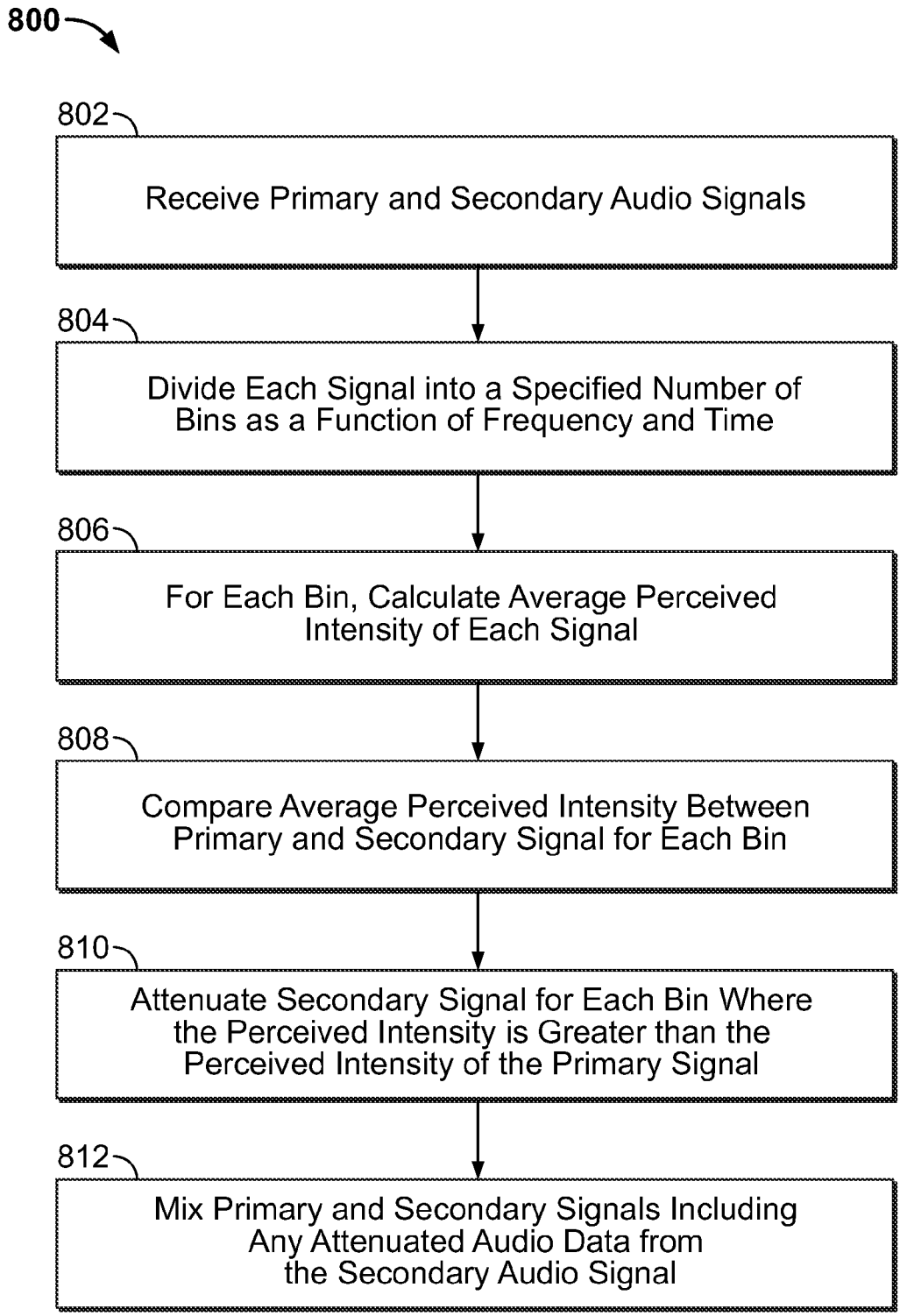
FIG. 8 is flow chart of an example method for combining audio signals to reduce masking.

FIG. 8 is a flow chart of an example method 800 for combining audio signals to reduce masking. For convenience, the method 800 will be described with respect to a system that will perform the method 800.

The system receives 802 a primary audio signal and a secondary audio signal. The audio signals can be individual audio signals or audio signals that have been combined from a previous mixing process.

The system divides 804 each audio signal into corresponding bins as a function of frequency and time. The resolution of the bin with respect to frequency depends on the time duration for the bin. For example, to achieve a frequency resolution of one Hz, a bin duration of one second is required. The time interval for the bins is selected to minimize a user's perception of the processing being performed on each individual bin. In some implementations, 200 frequency bands can be used when the duration of each bin is ten milliseconds. The bins correspond between the primary and secondary audio signals such that each bin of the primary audio signal has a corresponding bin in the secondary audio signal.

In some implementations, the primary and secondary audio signals have different durations. When this occurs, the system uses the duration of the shorter audio signal. The system starts with the beginning of the shorter audio signal and ends at the end of the shorter audio signal. Thus, the masking is not reduced for the additional portion of the longer audio signal. In some other implementations, one or both of the audio signals is non-contiguous. In this case, the system treats each section of the audio signals as an independent signal.

To generate a particular bin, Fourier transforms can be calculated over specified time slices. For example, the system can isolate a portion of the audio signal for a duration of a specified number of samples. The system can then use Fourier transforms to separate the audio data for each frequency band within the isolated portion to form each bin. The process can be repeated, serially or in parallel, for each time duration.

The number of samples is a function of a sample rate. For example, for a sample rate of 44 kHz, the sample interval is substantially 1/44,000 seconds. Therefore, if the time duration for each bin is substantially 10 ms, there are 440 samples in each bin.

The audio signal can be isolated in time slices having 440 samples using, for example, a windowing function (e.g., a Blackman-Harris window). The windowing function is a particular function that is zero valued outside of the region defined for each time slice defined by the window. Consequently, operations can be performed on the time slice (e.g., using FFTs to divide the audio data into frequency bands, calculating average perceived intensity for each band) in isolation from the other audio data of each audio signal. Bins can be formed from each time slice according to frequency band within the time slice.

In some implementations, each time slice is partially overlapping with adjacent time slices. Overlapping time slices can provide greater accuracy for the Fourier transforms, which typically have a greater accuracy at the center of the time slice relative to the edges. Thus, by overlapping time slices, the system can compensate for reduced accuracy at time slice edges.

Figure 9:
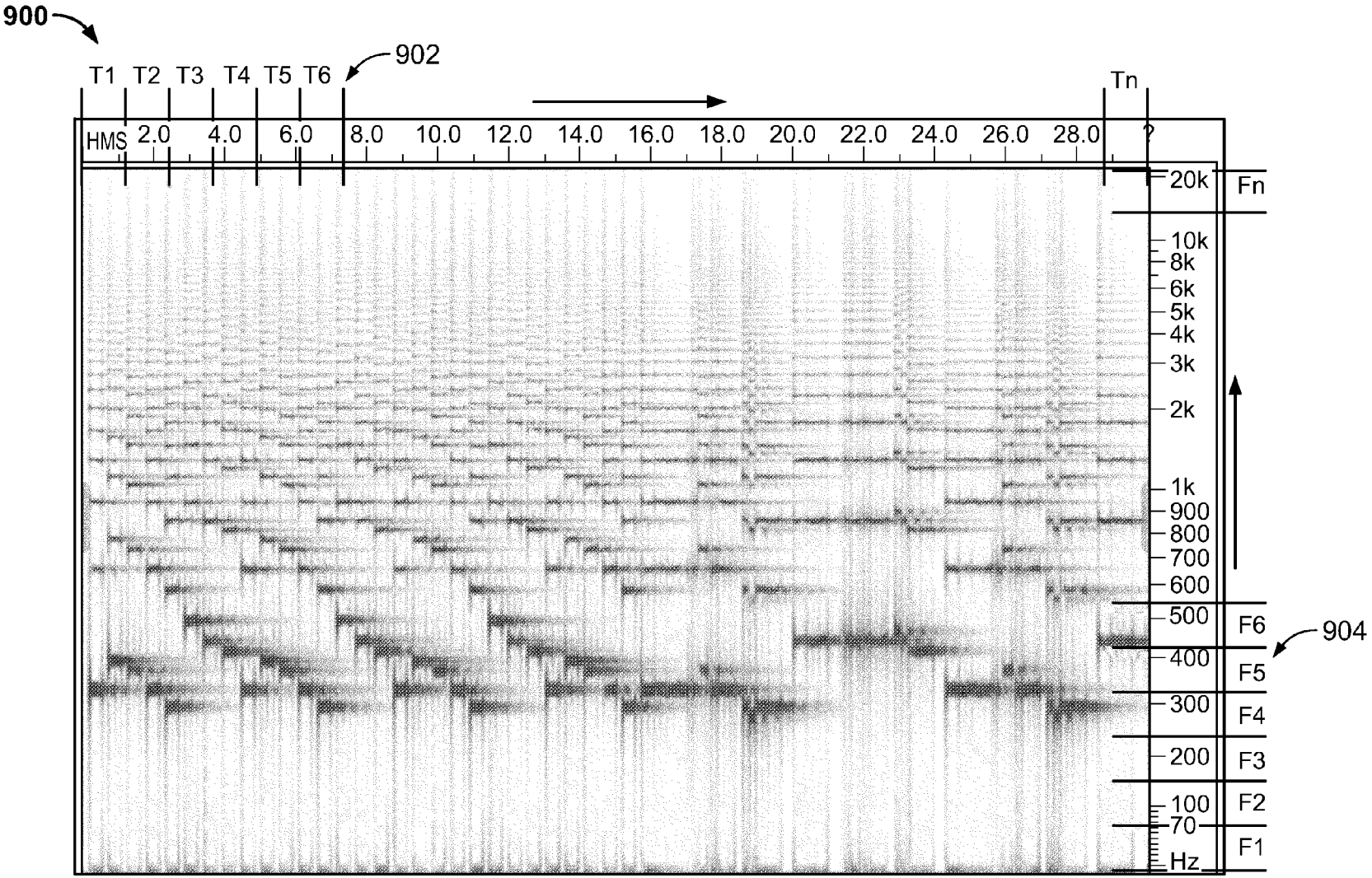
FIG. 9 shows an example frequency spectrogram for an audio signal showing bins as a function of frequency and time.

FIG. 9 shows an example frequency spectrogram 900 for an audio signal showing bins as a function of frequency and time. The frequency spectrogram 900 illustrates the audio data of an audio signal as a function of frequency and time, where frequency is shown in Hz on a logarithmic scale on the y-axis and time is shown in seconds on the x-axis. Additionally, time slices 902 are shown ranging from $T_1$ to $T_n$ along with frequency bands 904 ranging from $F_1$ to $F_n$. Each intersection of time slices and frequency bands forms a particular bin of audio data for the audio signal.

As shown in FIG. 8, for each bin, the system calculates 806 an average perceived intensity of each audio signal. For example, for a first bin defined by a time length of 10 ms and a frequency range of 100 Hz to 200 Hz, an average perceived intensity of the audio data within that bin is calculated. For example, the average perceived intensity can be calculated as described above with respect to FIG. 3, only over the bin duration and not the entire audio signal. For example, instead of sampling perceived intensity at points across the entire audio data, the system samples points bounded by the bin duration. In some implementations, the perceived intensity is calculated for each sample within the bin and then averaged. Thus, if there are 440 samples per bin, the system calculates 440 perceived intensity values and averages them.

The system compares 808 the average perceived intensity between primary and secondary audio signals for each bin. The average perceived intensities are compared to determine whether the average perceived intensity of audio data of the secondary audio signal is greater than the average perceived intensity of the audio data of the primary audio signal for each bin.

The system attenuates 810 the audio data of the secondary audio signal for each bin where the average perceived intensity of the secondary audio signal is greater than the average perceived intensity of the primary audio signal by some threshold amount. When the average perceived intensity of the secondary audio signal is not greater than the average perceived intensity of the primary audio signal for a particular bin, the system maintains the average perceived intensity of the primary audio signal and the secondary audio signal. Thus, the system does not modify audio data within the bin of the secondary audio signal.

However, when the average perceived intensity of the secondary audio signal is greater than the average perceived intensity of the primary audio signal for a particular bin, the system attenuates the audio data of the secondary audio signal within that bin. For example, the threshold amount can be a minimum difference between the average perceived intensity of the primary audio signal and the secondary audio signal. Alternatively, the threshold amount can be a threshold average perceived intensity floor for the primary audio signal. For example, a threshold floor can be selected such that the audio data is considered silence below the threshold floor. Thus, for a particular bin of the primary audio signal identified as silence, the secondary audio signal is not attenuated even though the average perceived intensity of the corresponding bin in the secondary audio signal is greater.

The audio data of the particular bin in the secondary audio signal can be attenuated such that the average perceived intensity of the bin for the secondary audio signal matches the average perceived intensity of the corresponding bin for the primary audio signal. For example, for a given bin, if the average perceived intensity of the audio data from the secondary audio signal is −10 dB and the average perceived intensity of the audio data from the primary audio signal is −15 dB, the attenuation is performed to reduce the average perceived intensity of the bin from the secondary audio signal to −15 dB.

Alternatively, the attenuation amount can be a specified amount, e.g., −5 dB regardless of the difference between the average perceived intensities. Alternatively, the secondary audio signal can be attenuated such that the average perceived intensity is less than the average perceived intensity of the primary audio signal. In another example, the attenuation of the secondary audio signal can be a function of the average perceived intensity of the secondary audio signal (e.g., proportional to the magnitude of the average perceived intensity, based on the difference between the average perceived intensities).

The system mixes 812 the primary audio signal and the secondary audio signal including any attenuated audio data from bins of the secondary audio signal. For example, the mixer of the digital audio workstation can sum the primary audio signal and the modified secondary audio signal to generate a single mixed audio signal. The mixed audio signal can be output from the mixer for playback, further processing (e.g., as part of a signal processing change), editing in the digital audio workstation, saving as a single file locally or remotely, or transmitting or streaming to another location.

Additionally, the system can mix the mixed audio signal with other audio signals, for example, another audio signal that is primary to the mixed audio signal. The new primary audio signal can be mixed with the new secondary mixed audio signal in a similar manner as described above.

Figure 10:
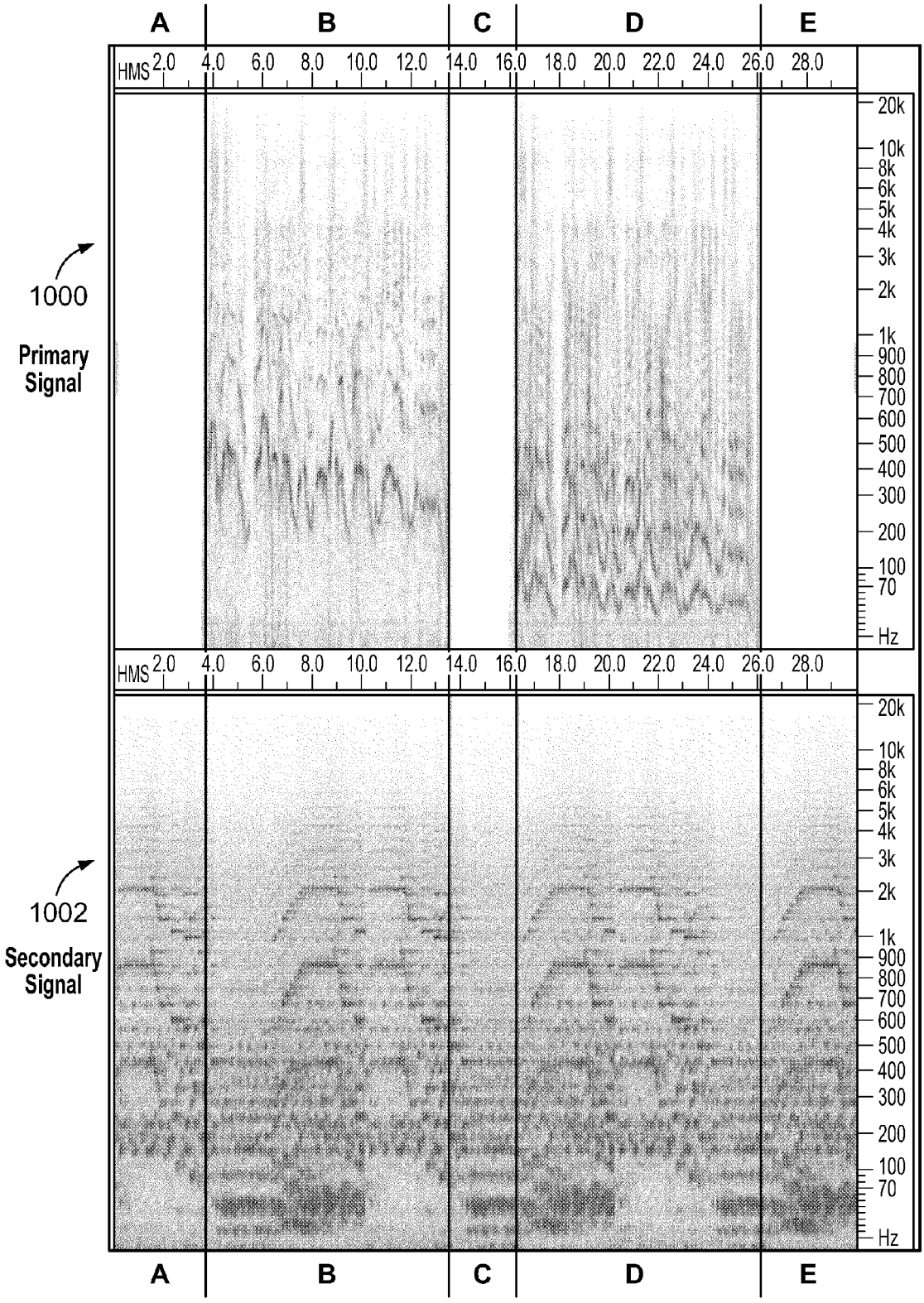
FIG. 10 shows example frequency spectrograms for a primary and secondary audio signal.

FIG. 10 shows example frequency spectrograms 1000 and 1002 for a primary audio signal and a secondary audio signal, respectively. Each frequency spectrogram displays a visual representation of audio data from the respective primary and secondary audio signals with respect to frequency and time. Additionally, the brightness of the audio data shown in frequency spectrograms 1000 and 1002 can vary to indicate intensity such that the darker areas indicate higher intensities. Thus, for example, the portions of frequency spectrogram 1000 that are completely white, portions A, C, and E indicate silence in the primary audio signal. Additionally, the primary audio signal in portions B and D represent voice over narration. As shown in frequency spectrogram 1000, the audio data represented in portion B has a generally higher frequency than the audio data represented in portion D.

When using the method 300 shown in FIG. 3, which calculates average perceived intensity over the entire audio signal, the portions of silence shown in the spectrogram of FIG. 10 will result in a lower calculated average perceived intensity for each of the frequency bands of the primary audio signal 1000. Thus, the secondary signal 1002 can be attenuated more than necessary. Additionally, portions A, C, and E (the silence) of the secondary audio signal corresponding to the silence in the primary audio signal will be unnecessarily processed. Since there is no primary signal corresponding to those portions, the secondary signal can be left unchanged.

By contrast, the method 800 shown in FIG. 8, calculates average perceived intensity for particular bins as a function of both frequency and time. As a result, the portions of silence, A, C, and E, will not hamper the calculation of average perceived intensity for bins within portions B and D for small time slices. Thus, the attenuation of the secondary signal will more closely track the perceived intensity of the primary audio signal at a given point in time.

In some implementations, having a single time slice (e.g., a time slice equal to the entire duration of the audio signal) is inefficient because portions of the primary signal contain audio data having zero intensity. However, the system can break the audio signal into multiple signals based on a silence threshold (e.g., a minimum intensity). For example, if the silence is zero intensity, the primary audio signal would be separated into two discrete signals. The system can then perform the masking reduction process on each audio signal separately as described above. Additionally, in some other implementations, the system averages together the average perceived intensity from each of the two discrete audio signals and uses that value as the average perceived intensity for the primary audio signal as a whole, which is then processed in a similar manner as described above with respect to FIG. 3.

Figure 11:
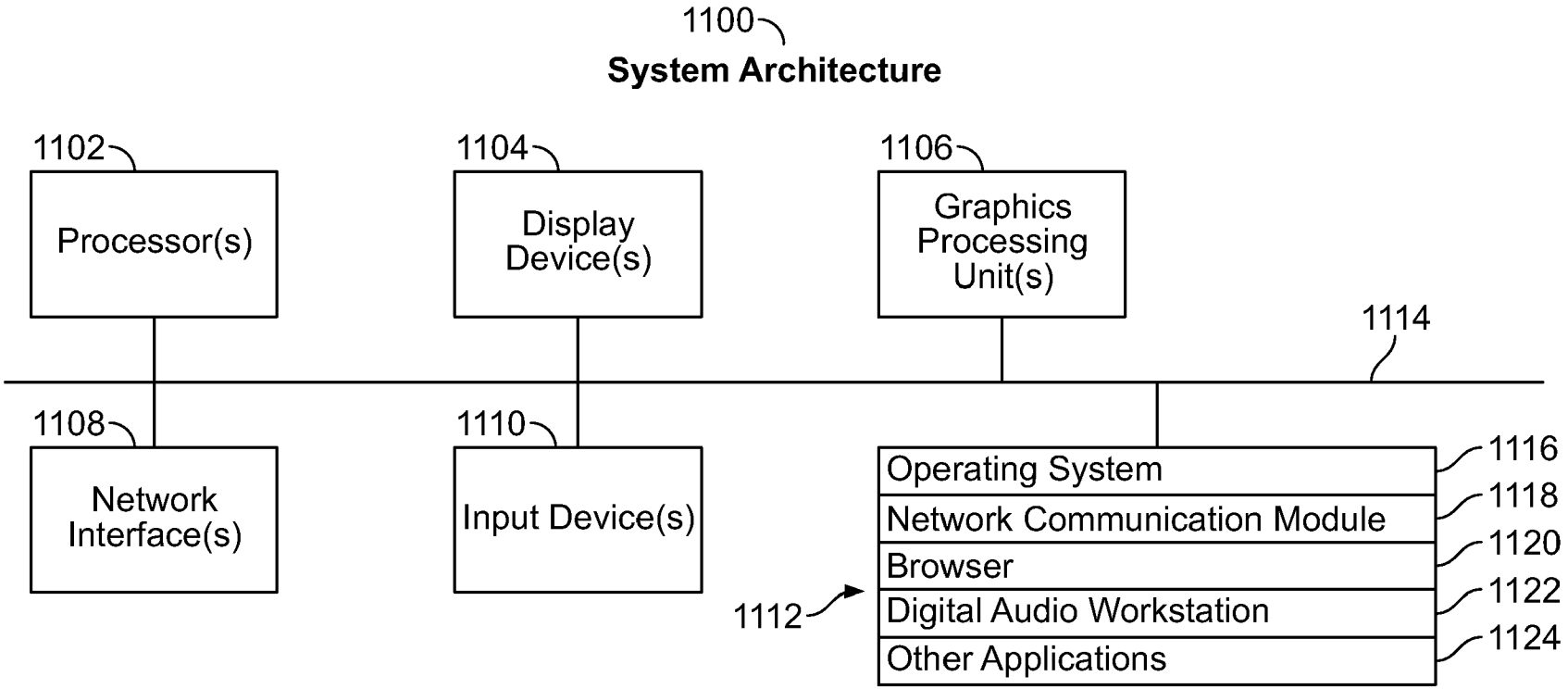
FIG. 11 is a block diagram of an exemplary user system architecture

FIG. 11 is a block diagram of an exemplary user system architecture 1100. The system architecture 1100 is capable of hosting a audio processing application that can electronically receive, display, and edit one or more audio signals. The architecture 1100 includes one or more processors 1102 (e.g., IBM PowerPC, Intel Pentium 4, etc.), one or more display devices 1104 (e.g., CRT, LCD), graphics processing units 1106 (e.g., NVIDIA GeForce, etc.), a network interface 1108 (e.g., Ethernet, FireWire, USB, etc.), input devices 1110 (e.g., keyboard, mouse, etc.), and one or more computer-readable mediums 1112. These components exchange communications and data via one or more buses 1114 (e.g., EISA, PCI, PCI Express, etc.).

The term "computer-readable medium" refers to any medium that participates in providing instructions to a processor 1102 for execution. The computer-readable medium 1112 further includes an operating system 1116 (e.g., Mac OS®, Windows®, Linux, etc.), a network communication module 1118, a browser 1120 (e.g., Safari®, Microsoft® Internet Explorer, Netscape®, etc.), a digital audio workstation 1122, and other applications 1124.

The operating system 1116 can be multi-user, multiprocessing, multitasking, multithreading, real-time and the like. The operating system 1116 performs basic tasks, including but not limited to: recognizing input from input devices 1110; sending output to display devices 1104; keeping track of files and directories on computer-readable mediums 1112 (e.g., memory or a storage device); controlling peripheral devices (e.g., disk drives, printers, etc.); and managing traffic on the one or more buses 1114. The network communications module 1118 includes various components for establishing and maintaining network connections (e.g., software for implementing communication protocols, such as TCP/IP, HTTP, Ethernet, etc.). The browser 1120 enables the user to search a network (e.g., Internet) for information (e.g., digital media items).

The digital audio workstation 1122 provides various software components for performing the various functions for displaying visual representations and editing audio data, as described with respect to FIGS. 1-10 including dividing the audio signals as functions of frequency or frequency and time, calculating average perceived intensity, comparing average perceived intensity between audio signals, and attenuating audio data from one or more audio signals.

Embodiments of the subject matter and the functional operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer program products, i.e., one or more modules of computer program instructions encoded on a computer-readable medium for execution by, or to control the operation of, data processing apparatus. The computer-readable medium can be a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A computer program (also known as a program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer-readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described is this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the invention have been described. Other embodiments are within the scope of the following claims. For example, the actions recited in the claims can be performed in a different order and still achieve desirable results.

What is claimed is:

1. A method comprising:

receiving a primary audio signal and a secondary audio signal;

for each audio signal, calculating an average perceived intensity over time for each of a plurality of frequency bands;

comparing the average perceived intensity of the secondary audio signal with the average perceived intensity of the primary audio signal for each frequency band; and for each frequency band where the average perceived intensity of the secondary audio signal is greater than the average perceived intensity of the primary audio signal by a specified threshold amount, attenuating the secondary audio signal by a specified amount to form a modified secondary audio signal.

2. The method of claim 1, where the secondary audio signal is attenuated for a particular frequency band by an amount such that the average perceived intensity of the secondary audio signal corresponds to the average perceived intensity of the primary audio signal for that frequency band.

3. The method of claim 1, where the average perceived intensity is calculated over an entire duration of the primary and the secondary audio signals, and where the attenuation of a particular frequency band attenuates the secondary audio signal at that frequency band over the entire audio signal.

4. The method of claim 1, where the average perceived intensity is calculated over an entire duration of a shorter audio signal of the primary and the secondary audio signals, and where the attenuation of a particular frequency band attenuates the secondary audio signal at that frequency band over a duration equal to the shorter audio signal.

5. The method of claim 1, further comprising:

receiving a first audio signal and a second audio signal; and calculating a priority between the first audio signal and the second audio signal such that the higher priority audio signal becomes the primary audio signal and the lower priority audio signal becomes the secondary audio signal.

6. The method of claim 1, further comprising:

receiving a plurality of audio signals;

calculating a relative priority for each audio signal of the plurality of audio signals;

arranging pairs of audio signals in a hierarchy according to priority, where each pair includes a primary audio signal and a secondary audio signal according to the calculated priority; and combining pairs of audio signals up the hierarchy to generate two audio signals.

7. The method of claim 1, further comprising:

mixing the primary audio signal and the modified secondary audio signal to provide a mixed output signal.

8. The method of claim 7, further comprising;

storing the mixed output signal.

9. The method of claim 1, where an amount of attenuation applied to the secondary signal is capped by a specified amount.

10. The method of claim 1, where the threshold amount is a minimum difference between the average perceived intensity of the primary audio signal and the average perceived intensity of the secondary audio signal.

11. The method of claim 1, further comprising:

identifying one or more regions of an audio signal of the primary and secondary audio signals as silence; and dividing the audio signal into two or more discrete audio signals, where the two or more discrete audio signals do not include the one or more regions identified as silence.

12. A method comprising:

receiving a primary audio signal and a secondary audio signal;

for each audio signal, separating the audio data into multiple time slices and frequency bands to form a plurality of bins, each bin including audio data for a particular frequency band and time duration;

calculating an average perceived intensity of each bin;

comparing the average perceived intensity of each bin in secondary audio signal with the average perceived intensity of a corresponding bin in the primary audio signal; and for each bin where the average perceived intensity of the secondary audio signal is greater than the average perceived intensity of the corresponding bin of the primary audio signal, attenuating the secondary audio signal corresponding to the bin by a specified amount to form a modified secondary audio signal bin, according to one or more criteria; and combining the modified secondary audio signal bins with unmodified secondary audio signal bins to form a modified secondary audio signal.

13. The method of claim 12, where the one or more criteria includes a primary audio signal threshold floor, where the primary threshold floor identifies a minimum average perceived intensity of audio data in a bin of the primary audio signal in order to apply an attenuation to corresponding bin of the secondary audio signal.

14. A computer program product, encoded on a computer-readable medium, operable to cause data processing apparatus to perform operations comprising:

receiving a primary audio signal and a secondary audio signal;

for each audio signal, calculating an average perceived intensity over time for each of a plurality of frequency bands;

comparing the average perceived intensity of the secondary audio signal with the average perceived intensity of the primary audio signal for each frequency band; and for each frequency band where the average perceived intensity of the secondary audio signal is greater than the average perceived intensity of the primary audio signal by a specified threshold amount, attenuating the secondary audio signal by a specified amount to form a modified secondary audio signal.

15. The computer program product of claim 14, where the secondary audio signal is attenuated for a particular frequency band by an amount such that the average perceived intensity of the secondary audio signal corresponds to the average perceived intensity of the primary audio signal for that frequency band.

16. The computer program product of claim 14, where the average perceived intensity is calculated over an entire duration of the primary and the secondary audio signals, and where the attenuation of a particular frequency band attenuates the secondary audio signal at that frequency band over the entire audio signal.

17. The computer program product of claim 14, where the average perceived intensity is calculated over an entire duration of a shorter audio signal of the primary and the secondary audio signals, and where the attenuation of a particular frequency band attenuates the secondary audio signal at that frequency band over a duration equal to the shorter audio signal.

18. The computer program product of claim 14, further operable to perform operations comprising:

receiving a first audio signal and a second audio signal; and calculating a priority between the first audio signal and the second audio signal such that the higher priority audio signal becomes the primary audio signal and the lower priority audio signal becomes the secondary audio signal.

19. The computer program product of claim 14, further operable to perform operations comprising:

receiving a plurality of audio signals;

calculating a relative priority for each audio signal of the plurality of audio signals;

arranging pairs of audio signals in a hierarchy according to priority, where each pair includes a primary audio signal and a secondary audio signal according to the calculated priority; and combining pairs of audio signals up the hierarchy to generate two audio signals.

20. The computer program product of claim 14, further operable to perform operations comprising:

mixing the primary audio signal and the modified secondary audio signal to provide a mixed output signal.

21. The computer program product of claim 20, further operable to perform operations comprising:

storing the mixed output signal.

22. The computer program product of claim 14, where an amount of attenuation applied to the secondary signal is capped by a specified amount.

23. The computer program product of claim 14, where the threshold amount is a minimum difference between the average perceived intensity of the primary audio signal and the average perceived intensity of the secondary audio signal.

24. The computer program product of claim 14, further operable to perform operations comprising:

identifying one or more regions of an audio signal of the primary and secondary audio signals as silence; and dividing the audio signal into two or more discrete audio signals, where the two or more discrete audio signals do not include the one or more regions identified as silence.

25. A computer program product, encoded on a computer-readable medium, operable to cause data processing apparatus to perform operations comprising:

receiving a primary audio signal and a secondary audio signal;

for each audio signal, separating the audio data into multiple time slices and frequency bands to form a plurality of bins, each bin including audio data for a particular frequency band and time duration;

calculating an average perceived intensity of each bin;

comparing the average perceived intensity of each bin in secondary audio signal with the average perceived intensity of a corresponding bin in the primary audio signal; and for each bin where the average perceived intensity of the secondary audio signal is greater than the average perceived intensity of the corresponding bin of the primary audio signal, attenuating the secondary audio signal corresponding to the bin by a specified amount to form a modified secondary audio signal bin, according to one or more criteria; and combining the modified secondary audio signal bins with unmodified secondary audio signal bins to form a modified secondary audio signal.

26. The computer program product of claim 25, where the one or more criteria includes a primary audio signal threshold floor, where the primary threshold floor identifies a minimum average perceived intensity of audio data in a bin of the primary audio signal in order to apply an attenuation to corresponding bin of the secondary audio signal.

27. A system comprising:

a user interface device; and one or more computers operable to interact with the user interface device and to perform operations including:

receiving a primary audio signal and a secondary audio signal;

for each audio signal, calculating an average perceived intensity over time for each of a plurality of frequency bands;

comparing the average perceived intensity of the secondary audio signal with the average perceived intensity of the primary audio signal for each frequency band; and for each frequency band where the average perceived intensity of the secondary audio signal is greater than the average perceived intensity of the primary audio signal by a specified threshold amount, attenuating the secondary audio signal by a specified amount to form a modified secondary audio signal.

28. The system of claim 27, where the secondary audio signal is attenuated for a particular frequency band by an amount such that the average perceived intensity of the secondary audio signal corresponds to the average perceived intensity of the primary audio signal for that frequency band.

29. The system of claim 27, where the average perceived intensity is calculated over an entire duration of the primary and the secondary audio signals, and where the attenuation of a particular frequency band attenuates the secondary audio signal at that frequency band over the entire audio signal.

30. The system of claim 27, where the average perceived intensity is calculated over an entire duration of a shorter audio signal of the primary and the secondary audio signals, and where the attenuation of a particular frequency band attenuates the secondary audio signal at that frequency band over a duration equal to the shorter audio signal.

31. The system of claim 27, further operable to perform operations comprising:

receiving a first audio signal and a second audio signal; and calculating a priority between the first audio signal and the second audio signal such that the higher priority audio signal becomes the primary audio signal and the lower priority audio signal becomes the secondary audio signal.

32. The system of claim 27, further operable to perform operations comprising:

receiving a plurality of audio signals;

calculating a relative priority for each audio signal of the plurality of audio signals;

arranging pairs of audio signals in a hierarchy according to priority, where each pair includes a primary audio signal and a secondary audio signal according to the calculated priority; and combining pairs of audio signals up the hierarchy to generate two audio signals.

33. The system of claim 27, further operable to perform operations comprising:

mixing the primary audio signal and the modified secondary audio signal to provide a mixed output signal.

34. The system of claim 33, further operable to perform operations comprising:

storing the mixed output signal.

35. The system of claim 27, where an amount of attenuation applied to the secondary signal is capped by a specified amount.

36. The system of claim 27, where the threshold amount is a minimum difference between the average perceived intensity of the primary audio signal and the average perceived intensity of the secondary audio signal.

37. The system of claim 27, further operable to perform operations comprising:

identifying one or more regions of an audio signal of the primary and secondary audio signals as silence; and dividing the audio signal into two or more discrete audio signals, where the two or more discrete audio signals do not include the one or more regions identified as silence.

38. A system comprising:

a user interface device; and one or more computers operable to interact with the user interface device and to perform operations including:

receiving a primary audio signal and a secondary audio signal;

for each audio signal, separating the audio data into multiple time slices and frequency bands to form a plurality of bins, each bin including audio data for a particular frequency band and time duration;

calculating an average perceived intensity of each bin;

comparing the average perceived intensity of each bin in secondary audio signal with the average perceived intensity of a corresponding bin in the primary audio signal; and for each bin where the average perceived intensity of the secondary audio signal is greater than the average perceived intensity of the corresponding bin of the primary audio signal, attenuating the secondary audio signal corresponding to the bin by a specified amount to form a modified secondary audio signal bin, according to one or more criteria; and combining the modified secondary audio signal bins with unmodified secondary audio signal bins to form a modified secondary audio signal.

39. The system of claim 38, where the one or more criteria includes a primary audio signal threshold floor, where the primary threshold floor identifies a minimum average perceived intensity of audio data in a bin of the primary audio signal in order to apply an attenuation to corresponding bin of the secondary audio signal.

* * * * *